US008057249B1

(12) United States Patent
Tobey et al.

(10) Patent No.: US 8,057,249 B1
(45) Date of Patent: Nov. 15, 2011

(54) ELECTRICAL CONNECTOR WITH SLIM-LINE CAP

(75) Inventors: Shawn Phillip Tobey, Trinity, NC (US); Jeffrey Lane McNeal, Winston-Salem, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/838,556

(22) Filed: Jul. 19, 2010

(51) Int. Cl.
*H01R 4/50* (2006.01)
*H01R 13/625* (2006.01)
*H01R 24/00* (2006.01)

(52) U.S. Cl. ..... 439/345; 439/536; 439/676

(58) Field of Classification Search ..... 439/676, 439/144, 345, 344, 147, 544, 536
See application file for complete search history.

(56) References Cited

U.S. PATENT DOCUMENTS

| | | | | |
|---|---|---|---|---|
| 4,040,699 | A * | 8/1977 | Rasmussen | 439/344 |
| 4,349,236 | A | 9/1982 | Guelden | |
| D274,143 | S | 6/1984 | Topel | |
| 4,655,529 | A * | 4/1987 | Yokoyama | 439/535 |
| 4,713,016 | A * | 12/1987 | Kato | 439/137 |
| 4,756,695 | A * | 7/1988 | Lane et al. | 439/76.1 |
| 4,883,432 | A | 11/1989 | Reed | |
| D318,847 | S | 8/1991 | Reed | |
| 5,096,442 | A | 3/1992 | Arnett et al. | |
| 5,118,311 | A | 6/1992 | Margini | |
| 5,125,852 | A | 6/1992 | Archer | |
| 5,217,190 | A | 6/1993 | Reed et al. | |
| 5,224,868 | A * | 7/1993 | Tseng | 439/136 |
| 5,228,869 | A | 7/1993 | Below | |
| 5,228,872 | A | 7/1993 | Liu | |
| 5,518,423 | A | 5/1996 | Green et al. | |
| 5,599,190 | A * | 2/1997 | Willette | 439/49 |
| 5,599,206 | A * | 2/1997 | Slack et al. | 439/536 |
| 5,647,763 | A * | 7/1997 | Arnold et al. | 439/540.1 |
| 5,704,797 | A | 1/1998 | Meyerhoefer et al. | |
| D397,323 | S | 8/1998 | Tulley et al. | |
| 6,241,546 | B1 | 6/2001 | Lee et al. | |
| 6,494,741 | B2 | 12/2002 | Handa et al. | |
| 6,527,593 | B2 | 3/2003 | Handa et al. | |
| 6,869,297 | B2 * | 3/2005 | Caveney | 439/138 |
| 7,364,444 | B2 * | 4/2008 | Kellock et al. | 439/138 |
| 7,594,829 | B2 | 9/2009 | Vaden et al. | |
| 7,651,369 | B2 | 1/2010 | Siemon et al. | |
| 2009/0017656 | A1 | 1/2009 | Lee | |

FOREIGN PATENT DOCUMENTS

| | | |
|---|---|---|
| EP | 0080247 | 6/1983 |
| EP | 0763961 | 3/1997 |
| GB | 2279500 | 1/1995 |
| JP | 03034275 A * | 2/1991 |
| JP | 2007317515 | 12/2007 |

* cited by examiner

*Primary Examiner* — Hae Moon Hyeon

(57) ABSTRACT

An electrical connector includes a mating end having a plug interface. The mating end has a retaining surface defined around the plug interface. At least one retention feature is provided on the retaining surface. A cap is provided having a plurality of sides and a front face. An opening extends through the front face. The cap is mounted to the mating end so that at least one of the plurality of sides of the cap engages the at least one retention feature to secure the cap to the mating end. The plug interface is accessible through the opening in the cap. The electrical connector is configured to be rear mounted to a panel so that the plug interface is accessible through an opening in the panel and the front face of the cap is capable of positioning flush with a front face of the panel.

20 Claims, 8 Drawing Sheets

ELECTRICAL CONNECTOR WITH SLIM-LINE CAP

BACKGROUND OF THE INVENTION

The subject matter described herein relates generally to electrical connectors and, more particularly, to an electrical connector having a slim-line cap.

Electrical connectors are often used to receive data plugs, network plugs, phone plugs, or the like. The connector may be positioned in a panel, wall, or other similar structure. A panel is coupled to a telecommunication rack with electrical connectors mounted in high density application. Generally, a panel is coupled to the wall to protect the electrical connector from damage. The panel also protects users of the electrical connector from electrical signals being transmitted through the electrical connector. The electrical connector includes a plug interface to receive the plug. The electrical connector is engaged with the panel so that the plug interface is accessible through an opening in the panel. A cap may be positioned around the plug interface to align the plug interface with the opening. The cap may include internal coupling mechanisms to retain the plug within the plug interface. The cap may also include external coupling mechanisms to retain the connector to the panel.

However, conventional electrical connectors experience certain disadvantages. The cap positioned around the plug interface typically protrudes outward from the connector body increasing the overall envelope of space. This typically results in cap extending beyond the surface of the panel. This may also require a larger opening in the panel. It is desirable to have a flush mounted connector to the panel for cosmetic appearance and to keep the connector protected. It is also desirable to allow the cap to be used with an existing industry standard panel window opening to allow compatibility with existing applications.

Additionally, caps that mechanically engage the plug may be disengaged by forces exerted on the plug. For example, an axial force on the plug may cause the cap to become dislodged from the electrical connector, thereby damaging the connector. Alternatively, if the plug is sharply bent, the plug may create angular forces that dislodge the cap from the electrical connector.

Lastly, conventional caps positioned on the electrical connector are not interchangeable with existing panels or faceplates that are commonly used in the industry. When installing a new connector to an existing application, the cap may not match the contours, window size, and/or colors of the panel. Accordingly, the panel must be entirely replaced to match the electrical connector.

A need remains for an interchangeable electrical connector cap that positions flush with a surface of the panel. Another need remains for an electrical connector cap that can be used with existing panels that have a standard window size that is commonly used in the industry.

SUMMARY OF THE INVENTION

In one embodiment, an electrical connector is provided. The electrical connector including a housing having a body with a cable end and a mating end. The mating end including a plug interface configured to receive a plug. The mating end having a retaining surface defined around the plug interface. At least one retention feature provided on the retaining surface. A cap is provided having a body defined by a plurality of sides. A front face extends at least partially between the plurality of sides. An opening extends through the front face.

The cap is mounted to the mating end of the housing so that at least one of the plurality of sides of the cap engages the at least one retention feature to secure the cap to the housing. The plug interface of the housing is accessible through the opening in the cap. The housing is configured to be rear mounted to a panel so that the plug interface is accessible through an opening in the panel and the front face of the cap enables the connector to be positioned flush with a front face of the panel.

In another embodiment, an electrical assembly is provided. The electrical assembly includes an electrical connector including a housing having a body with a cable end and a mating end. The mating end includes a plug interface configured to receive a plug. The mating end has a retaining surface defined around the plug interface. At least one retention feature is provided on the retaining surface. A cap is provided having a body defined by a plurality of sides. A front face extends at least partially between the plurality of sides. An opening extends through the front face. The cap is mounted to the mating end of the electrical connector so that at least one of the plurality of sides of the cap engages the at least one retention feature to secure the cap to the electrical connector. The plug interface of the electrical connector is partially formed and is accessible through the opening in the cap. The cap is configured to engage install onto the electrical connector without increasing a density of the electrical connector so that the electrical connector is mountable in an existing panel. The electrical connector is rear mounted to the existing panel so that the plug interface is accessible through an opening in the existing panel.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figures 1, 2, 3:
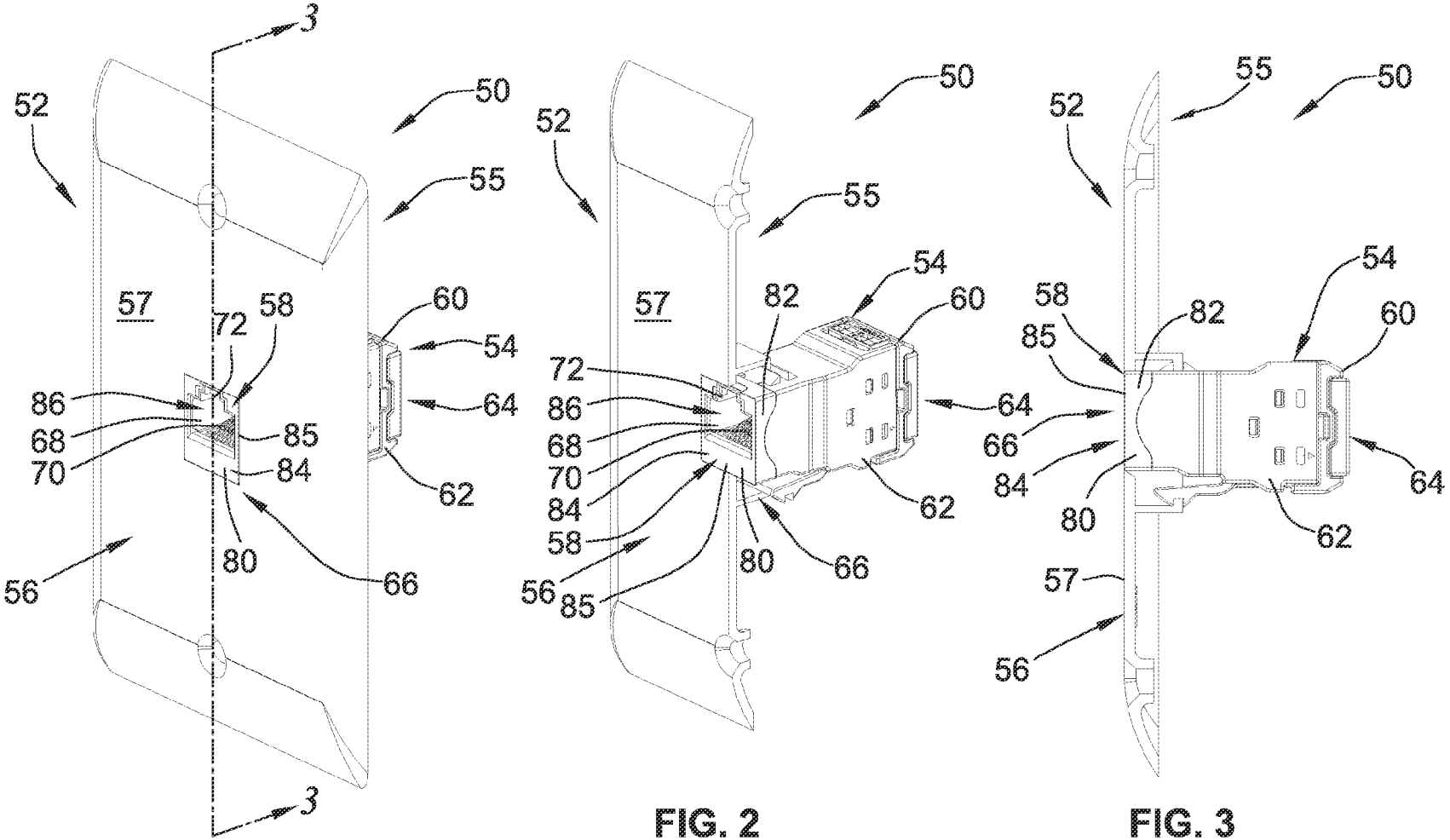
FIG. 1 is a perspective view of an electrical assembly formed in accordance with an embodiment.
FIG. 2 is a perspective view of the electrical connector, shown in FIG. 1, and a cross-sectional view of the panel, shown in FIG. 1, taken along the line 3-3 of FIG. 1.
FIG. 3 is a side view of the electrical connector, shown in FIG. 1, and a cross-sectional view of the panel, shown in FIG. 1, taken along the line 3-3 of FIG. 1.

FIG. 1 illustrates an electrical assembly 50 formed in accordance with an embodiment. The electrical assembly 50 includes a panel 52 and an electrical connector 54. FIGS. 2 and 3 illustrate the electrical connector 54 and a cross-sectional view of the panel 52, taken along the line 3-3 of FIG. 1. The panel 52 is illustrated as a face plate that is configured to be mounted on a wall. Optionally, the panel 52 may be a wall or a panel coupled to a wall. The electrical connector 54 engages the panel 52. The panel 52 includes a front face 56 and a rear 55. The front face 56 has a surface 57 that may be planar. Alternatively, the front face 56 may have a non-planar surface. The front face 56 may include a uniform surface or a non-uniform surface. The front face 56 has an opening 58 extending therethrough. The electrical connector 54 is configured to be rear mounted to the panel 52 so that the electrical connector 54 is received in the opening 58.

The electrical connector 54 includes a connector housing 60 having a connector body 62. The connector body 62 includes a cable end 64 and a mating end 66. The cable end 64 is configured to join a cable extending through a wall or along a surface to which the panel 52 is coupled. The mating end 66 is received in the opening 58 of the panel 52 when the electrical connector 54 is engaged with the panel 52. The mating end 66 includes a plug interface 68 configured to receive a plug. For example, in the illustrated embodiment, the plug interface 68 is a jack configured to receive a plug. The plug interface 68 may be configured to receive data plugs, network plugs, phone plugs, or the like.

The plug interface 68 is accessible through the opening 58 in the panel 52 so that a plug inserted into the opening 58 engages the plug interface 68. The plug interface 68 includes electrical contacts 70 that are configured to electrically couple to corresponding electrical contacts on a plug to transfer data signals therebetween. A plug latch 72 is configured to mate with a corresponding latch on the plug to secure the plug within the plug interface 68. The plug may be secured in the plug interface 68 without securing to the panel 52.

A cap 80 is positioned on the mating end 66 of the connector body 62. The cap 80 includes sides 82 and has a front face 84 extending at least partially between the sides 82. The front face 84 has a surface 85 that corresponds to the surface 57 of the front face 56 of the panel 52. The surface 85 may be planar. Alternatively, the front face 84 may have a non-planar surface 85. The front face 84 may include a uniform surface 85 or a non-uniform surface 85. An opening 86 extends through the front face 84. The cap 80 is joined the mating end 66 of the connector body 62. The sides 82 of the cap engage the mating end 66 of the connector body 62 so that the plug interface 68 is accessible through the opening 86 of the cap 80.

The electrical connector 54 rear mounted to the panel 52 so that the plug interface 68 is accessible through the opening 58 in the panel 52. The front face 84 of cap 80 is positioned flush with the front face 56 of the panel 52. The surface 85 of the cap 80 may be planar to correspond to a planar surface 57 of the panel 52. Alternatively, the surface 85 may be non-planar and configured to correspond to a non-planar surface 57 so that a transition between the surface 57 and the surface 85 is smooth. The electrical connector 54 is mounted to the panel 52 so that a step is not formed between the surface 57 and the surface 85. The cap 80 may be fabricated with a color that corresponds to a color of the panel 52.

The cap 80 is configured to mount to the connector housing 60 so that the overall envelope of space required for the electrical connector 54 is not increased by the cap 80. The cap 80 may be used with an existing industry standard panel window opening 58 to allow compatibility with existing applications. The existing panel 52 is therefore not required to be resized and/or replaced for use with the cap.

A plug is received in the plug interface 68 through the openings 58 and 86. Although the cap partially forms the plug interface 68, the cap 80 is designed so that pressure on the plug does not dislodge the cap 80. The plug is not configured to secure to the cap 80. Rather, the plug secures to the plug latch 72 of the plug interface that is located on the main body of the electrical connector 54. Pressure on the plug may include axial pressure that pulls the plug outward from the plug interface 68 in a direction perpendicular to the panel 52. The pressure may also include pressure applied at an angle to the panel 52.

Figure 4:
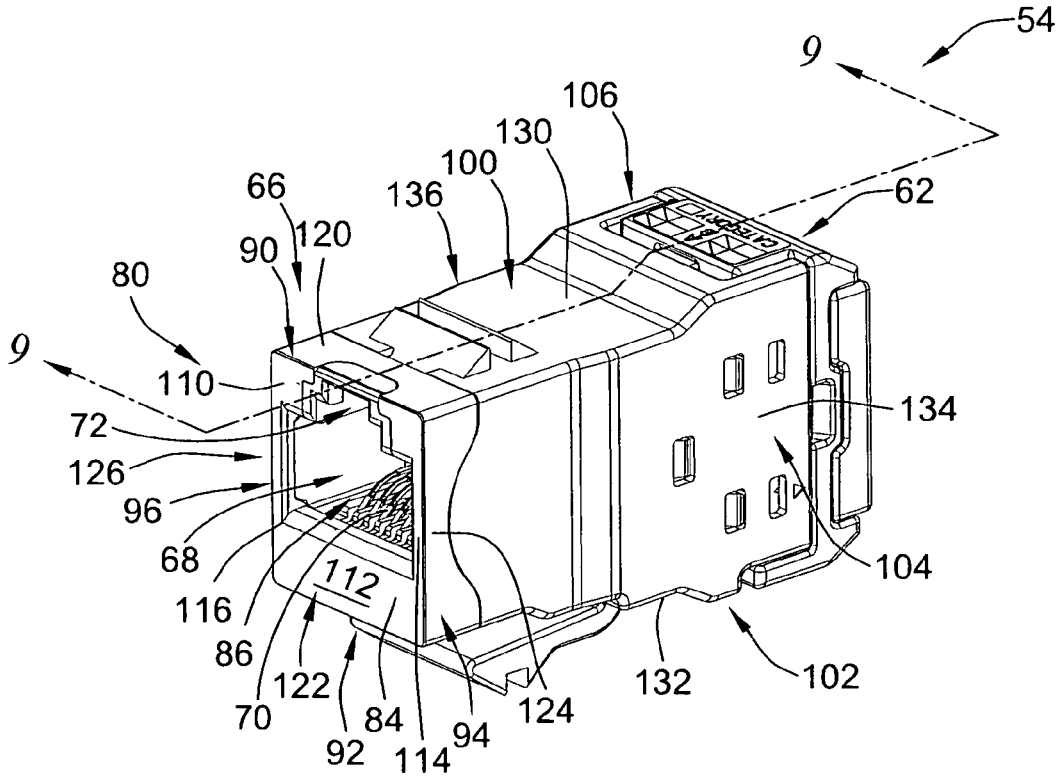
FIG. 4 is a perspective view of the electrical connector, shown in FIGS. 1-3.

FIG. 4 illustrates the electrical connector 54. The sides 82 of the cap 80 include a top 90, a bottom 92, and opposing sides 94 and 96 that extend between the top 90 and the bottom 92. In the illustrated embodiment, the sides 94 and 96 are symmetrical. Optionally, the sides 94 and 96 may have different configurations. The front face 84 of the cap 80 includes a top surface 110, a bottom surface 112, and opposing side surfaces 114 and 116. The surfaces 110, 112, 114, and 116 define the opening 86 in the front face 84. The top surface 110, the bottom surface 112, and the side surfaces 114 and 116 are joined to the corresponding top 90, bottom 92, and sides 94 and 96. A retention feature 98 is defined through the top 90 and the top surface 110 of the front face 84. The retention feature 98 is formed as a recess that extends through the top 90 and the top surface 110 of the front face 84.

The connector housing 60 includes a top 100, a bottom 102, and opposing sides 104 and 106 extending between the top 100 and the bottom 102. The cap 80 couples to the connector housing 60 so that the top 90, the bottom 92, and the sides 94 and 96 of the cap 80 engage the corresponding top 100, bottom 102, and sides 104 and 106 of the connector housing 60. A surface 120 of the top 90 of the cap 80 is positioned flush with a surface 130 of the top 100 of the connector housing 60. A surface 122 of the bottom 92 of the cap 80 is positioned flush with a surface 132 of the bottom 102 of the connector housing 60. A surface 124 and 126 of the sides 94 and 96, respectively, is positioned flush with a corresponding surface 134 and 136 of the sides 104 and 106, respectively, of the connector housing 60. The cap 80 is positioned on the connector housing 60 so that the surfaces 120, 122, 124, and 126 transition smoothly into the surfaces 130, 132, 134, and 136, respectively. The cap 80 and the connector housing 60 are configured to eliminate a step between the surfaces 120, 122, 124, and 126 and the surfaces 130, 132, 134, and 136, respectively.

The cap 80 is positioned on the mating end 66 of the connector body 62 so that the plug interface 68 is accessible through the opening 86 of the cap 80. The electrical contacts 70 of the plug interface 68 are accessible through the opening 86 of the front face 84 of the cap 80. The electrical contacts 70 are positioned adjacent to the bottom surface 112 of the front face 84. The plug latch 72 is also accessible through the opening 86. The plug latch 72 is accessible through the retention feature 98 formed in the top 90 and the top surface 110 of the front face 84.

Figure 5:
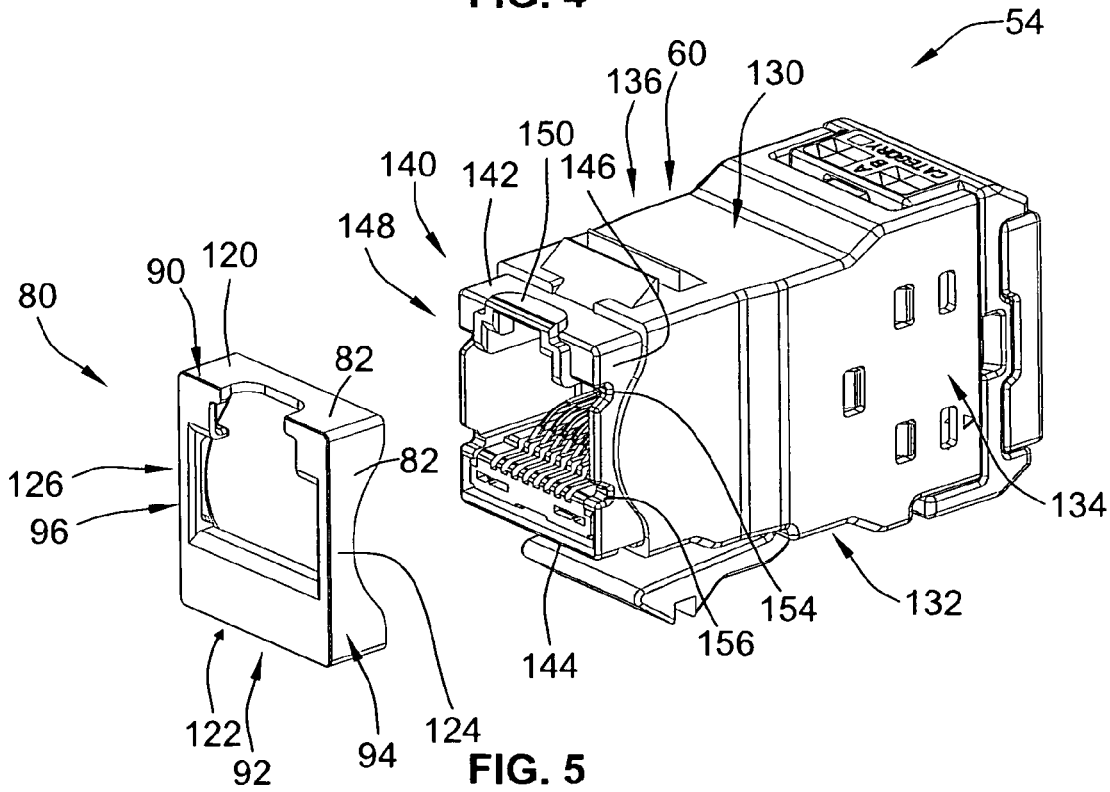
FIG. 5 is an exploded view of the electrical connector, shown in FIG. 4.
Figure 6:
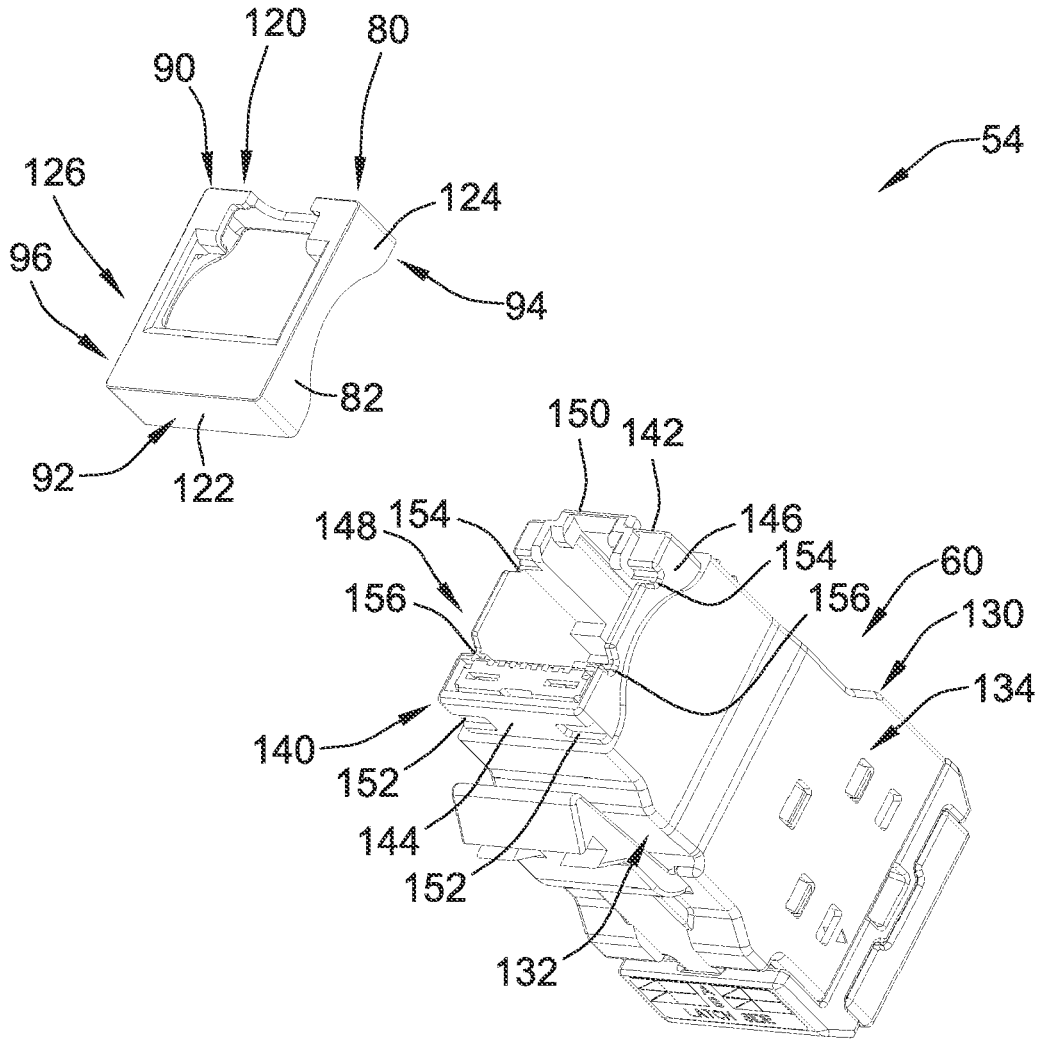
FIG. 6 is a bottom perspective exploded view of the electrical connector, shown in FIG. 4.

FIG. 5 is an exploded view of the electrical connector 54. FIG. 6 is a bottom perspective exploded view of the electrical connector 54. The connector housing 60 includes a retaining surface 140 that extends around the plug interface 68. The retaining surface 140 includes a top contour 142, a bottom contour 144, and side contours 146 and 148 that extend along the top 100, bottom 102, and sides 104 and 106, respectively, of the connector housing 60. The side contours 146 and 148 may be symmetrical. Optionally, the contours 146 and 148 may differ. The top 90 of the cap 80 corresponds to the top contour 142 of the connector housing 60. The bottom 92 of the cap 80 corresponds to the bottom contour 144 of the connector housing 60. The sides 94 and 96 of the cap 80 correspond to the side contours 146 and 148, respectively, of the connector housing 60. The sides 90, 92, 94, and 96 correspond with the contours 142, 144, 146, and 148 so that the surfaces 120, 122, 124, and 126 abut the surfaces 130, 132, 134, and 136, respectively, in a flush configuration when the cap 80 is joined with the connector housing 60.

The retaining surface 140 includes a plurality of retention features that are configured to engage the cap 80 when the cap 80 is positioned on the connector housing 60. The top contour 142 of the connector housing 60 includes a retention feature 150 that is configured to engage the top 90 of the cap 80 when the cap 80 is positioned on the connector housing 60. In the illustrated embodiment, the retention feature 150 is configured as a tab. Retention features 152 are formed on the bottom contour 144 of the connector housing 60 and are configured to engage the bottom 92 of the cap 80. In the illustrated embodiment, the retention features 152 are notches formed in the bottom contour 144. A retention feature 154 is formed in each side contour 146 and 148 proximate to the top contour 142. A retention feature 156 is also formed in each side contour 146 and 148 proximate to the bottom contour 144. In the exemplary embodiment, each retention feature 154 and 156 is formed as notch. In alternative embodiments, the retention features 150, 152, 154, and 156 may be formed as notches, tabs, grooves, latches, snaps, or the like.

Figure 8:
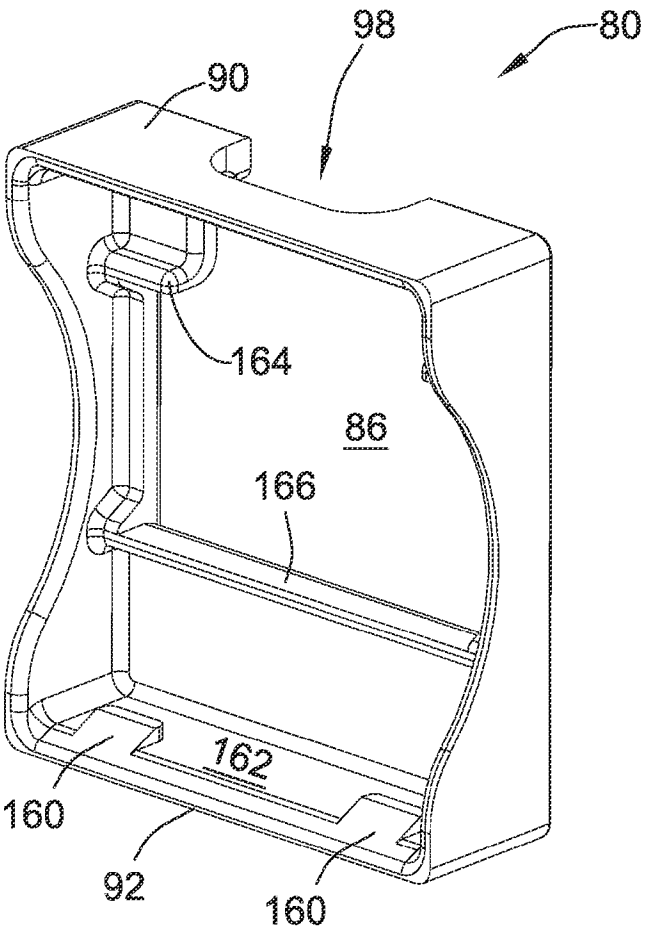
FIG. 8 is a rear perspective view of the cap, shown in FIG. 7.
Figure 7:
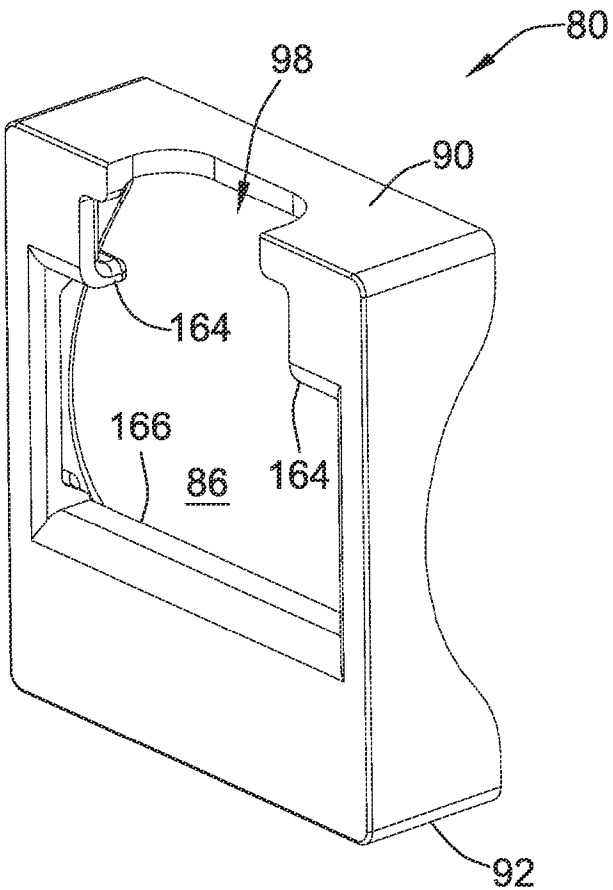
FIG. 7 is a front perspective view of the cap, shown in FIGS. 4-5.

FIG. 7 illustrates a front perspective view of the cap 80. FIG. 8 illustrates a rear perspective view of the cap 80. The cap 80 includes retention features that are configured to engage the retention features 150, 152, 154, and 156 of the connector housing 60. The top 90 of the cap 80 includes the retention feature 98 formed therein. The bottom 92 of the cap 80 also includes a pair of retention features 160. In the illustrated embodiment, the retention features 160 are formed as tabs that extend from an inner surface 162 of the bottom 92 of the cap 80. Retention features 164 extend from the top surface 110 of the front face 84 of the cap 80. The retention features 164 are formed as flanges that extend parallel to the top 90 of the cap 80 to define a portion of the opening 86. Another retention feature 166 extends from the bottom surface 112 of the front face 84 of the cap 80. The retention feature 166 is formed as a flange and extends parallel to the bottom 92 of the cap 80 to define a portion of the opening 86. In alternative embodiments, the retention features 98, 160, 164, and 166 may be any coupling mechanism that corresponds to and is configured to engage the retention features 150, 152, 154, and 156 of the connector housing 60, respectively. For example, the retention features 98, 160, 164, and 166 may be formed as notches, tabs, grooves, latches, snaps, or the like.

The retention features 98, 160, 164, and 166 of the cap 80 are configured to engage the retention features 150, 152, 154, and 156 of the housing 50, respectively, to secure the cap 80 to the connector housing 60. When the cap 80 is joined to the connector housing 60, the retention features 160 of the cap 80 are positioned with in the retention features 152 of the connector housing 60. The retention features 160 are received within the retention features 152 through an interference fit. The retention feature 166 of the cap 80 rests within the retention features 156 of the connector housing 60 and the retention features 164 of the cap 80 rest within the retention features 154 of the connector housing 60 to align the cap 80 with respect to the connector housing 60. The cap 80 is aligned so that the plug interface 68 is accessible through the opening 86. The retention feature 98 of the cap 80 is joined to the retention feature 150 of the connector housing 60. The retention feature 150 is received within the retention feature 98. The retention features 98 and 150 snap together to secure the cap 80 and the connector housing 60.

Figure 9:
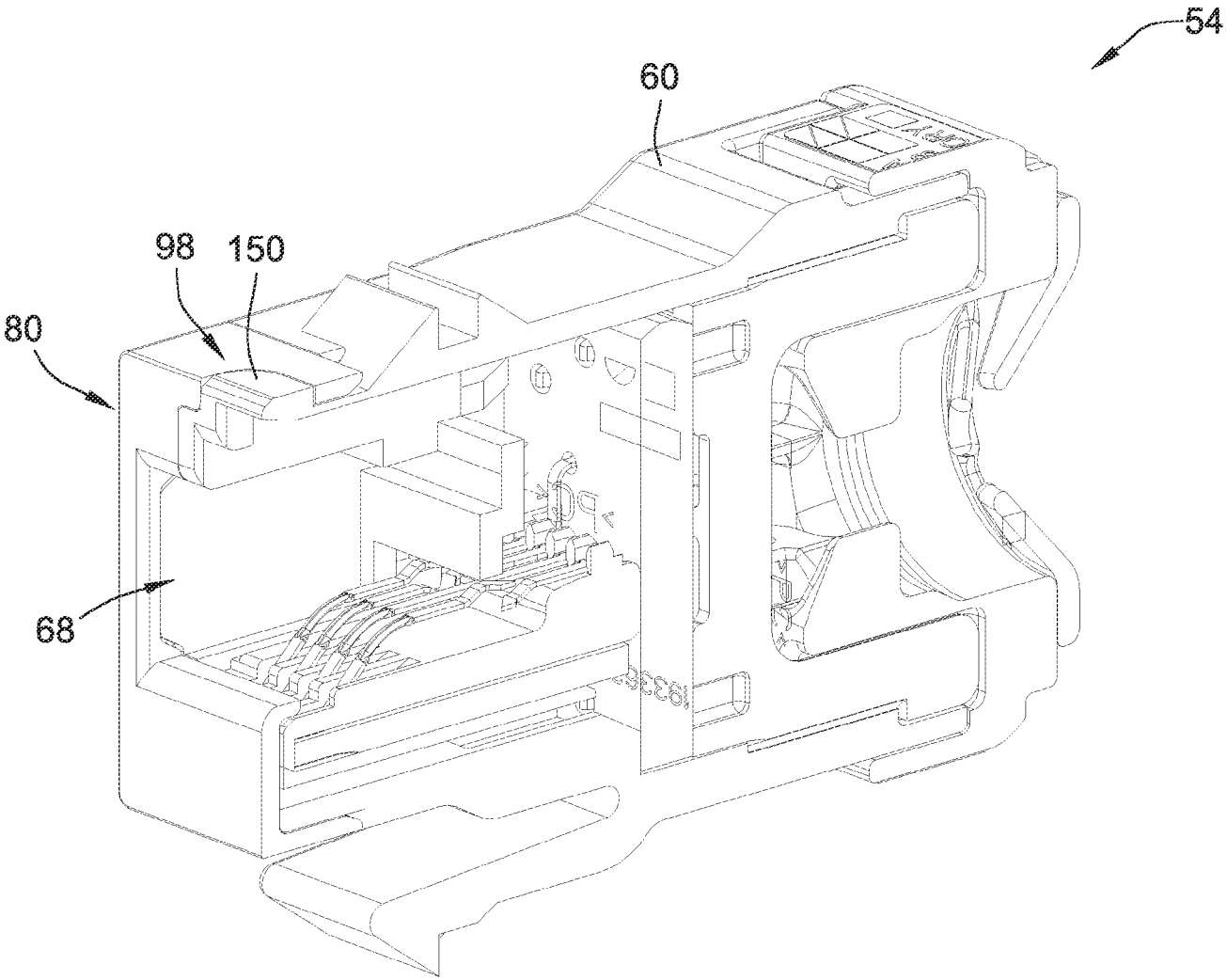
FIG. 9 is a cross-sectional view of the electrical connector, shown in FIG. 4, taken along the line 9-9 of FIG. 4.

FIG. 9 is a cross-sectional view of the electrical connector 54 taken along the line 9-9 of FIG. 4. FIG. 9 illustrates the retention feature 150 of the connector housing 60 positioned within the retention feature 98 of the cap 80. The retention feature 150 is removably coupled to the retention feature 98. To remove the cap 80 from the connector housing 60, force is applied to the retention feature 150 to disengage the retention features 98 and 150. The retention feature 150 slides out of engagement with the retention feature 98 to remove the cap 80. The cap 80 is replaceable with other caps 80 that may have a different color and/or have dust covers.

The cap 80 is removably coupled to the connector housing 60. The cap 80 is removable so that the cap 80 can be interchanged with other caps 80. When the cap 80 is installed onto the connector housing 60, it partially forms the plug interface 68. Forces exerted on the plug are transferred from the cap 80 to the connector housing 60, by flanges 164 that are designed to engage connector housing 60 to support the cap 80 and prevent it from dislodging when a perpendicular force is applied.

Figure 10:
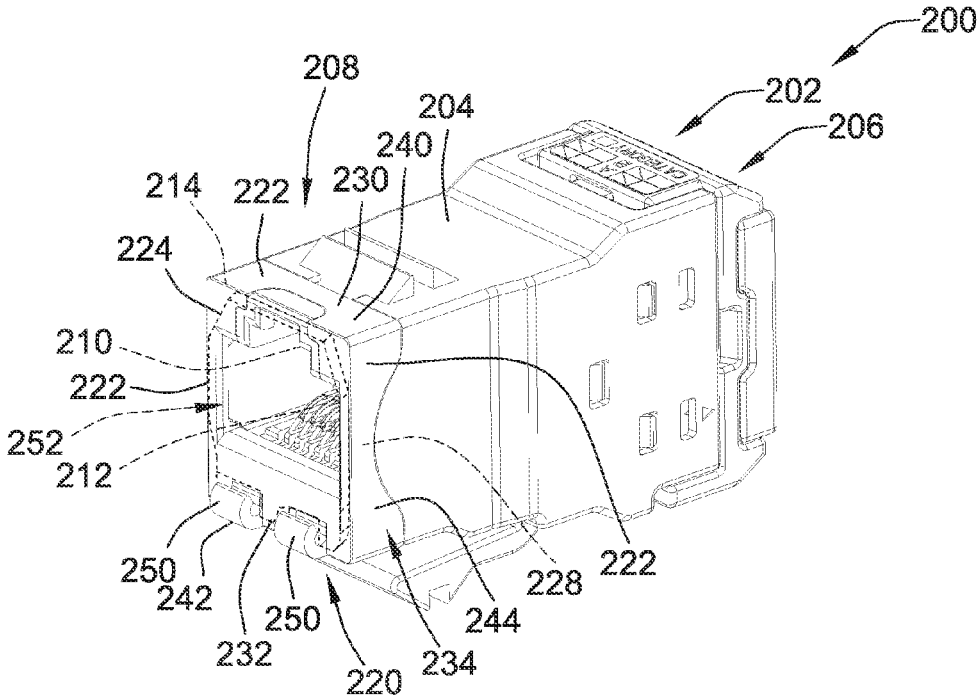
FIG. 10 is a perspective view of another electrical connector formed in accordance with an embodiment.

FIG. 10 illustrates another electrical connector 200 formed in accordance with an embodiment and that may be used with the electrical assembly 50 as illustrated in FIGS. 1-3. The electrical connector 200 includes a connector housing 202 having a connector body 204 with a cable end 206 and a mating end 208. A plug interface 210 is provided on the mating end 208. The plug interface 210 is accessible through the opening 58 in the panel 52. The plug interface 210 includes electrical contacts 212 that are configured to electrically couple to corresponding electrical contacts on a plug to transfer data signals therebetween. A plug latch 214 is configured to mate with a corresponding latch on the plug to secure the plug within the plug interface 210. The plug is secured in the plug interface 210 without securing to the panel 52.

A cap 220 is joined to the mating end 208 of the connector body 204. The cap 220 includes sides 222 and a front face 224 extending at least partially between the sides 222. The front face 224 has a surface 226 that is flush with the surface 57 of the front face 56 of the panel 52. The front face 224 includes an opening 228 extending therethrough. The sides 222 of the cap 220 engage the mating end 208 of connector body 204 so that the plug interface 210 is accessible through the opening 228 of the cap 220.

When the electrical connector 200 is rear mounted to panel 52, the surface 226 of the front face 224 of cap 220 is positioned flush with front face 56 of panel 52. The surface 226 of the cap 220 may be planar to correspond to a planar surface 57 of the panel 52. Alternatively, the surface 226 may be non-planar and configured to correspond to a non-planar surface 57 so that a transition between the surface 57 and the surface 226 is limited. The electrical connector 200 is mounted to the panel 52 so that a step is not formed between the surface 57 and the surface 226. The cap 220 may be fabricated with a color that corresponds to a color of the panel 52.

The cap 220 includes a top 230, a bottom 232, and a pair of opposed sides 234. The opposed sides 234 extend between the top 230 and the bottom 232. The front face 224 of the cap 220 includes a top surface 240, a bottom surface 242, and a pair of side surfaces 244. The top 230 is positioned adjacent the top surface 240, the bottom 232 is positioned adjacent the bottom surface 242, and the sides 234 are positioned adjacent a corresponding side surface 244. Hooks 250 extend from the bottom surface 242. The hooks 250 are configured to retain a dust cover 252. In a closed position, the dust cover 252 covers the opening 228 of the cap to prevent access to the plug interface 210. The dust cover 252 limits an amount of dust and debris that enters the plug interface 210. The dust cover 252 rotates about the hooks 250 into an open position, wherein the plug interface 210 is uncovered and accessible. In an alternative embodiment, the hooks 250 may be positioned on the top surface 240 or one of the side surfaces 244 of the front face 224 of the cap 220.

Figure 11:
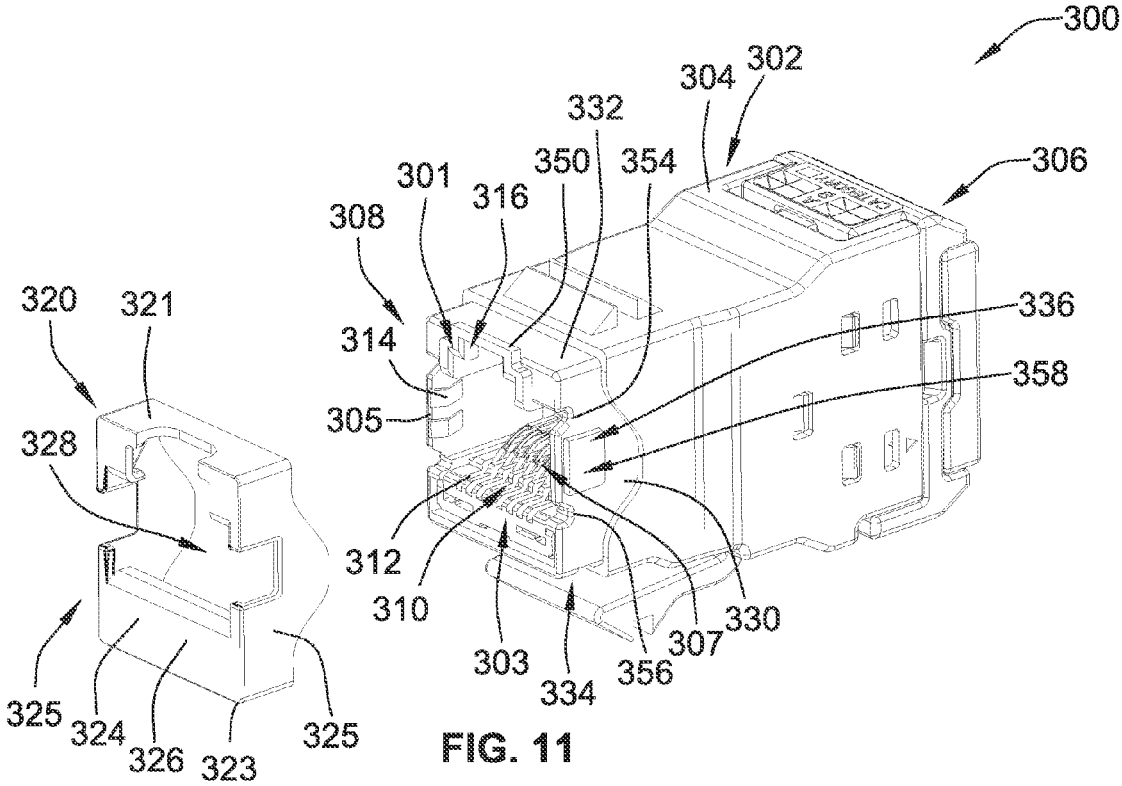
FIG. 11 is an exploded view of another electrical connector formed in accordance with an embodiment.

FIG. 11 is an exploded view of another electrical connector 300 formed in accordance with an embodiment and that may be used with the electrical assembly 50. The electrical connector 300 includes a connector housing 302 having a connector body 304 with a cable end 306 and a mating end 308. A plug interface 310 is provided on the mating end 308. The plug interface 310 is accessible through the opening 58 in the panel 52. The plug interface 310 includes a top 301, a bottom 303, and a pair of sides 305 and 307. The sides 305 and 307 extend between the top 301 and the bottom 303. Electrical contacts 312 are provided to electrically couple the plug interface 310 to corresponding electrical contacts on a plug to transfer data signals therebetween. The electrical contacts 312 extend along the bottom 303 of the plug interface 310. The plug interface 310 may also include electrical contacts 314 that are configured to provide shielding between the plug and the plug interface 310. The electrical contacts 314 are provided on the sides 305 and 307 of the plug interface 310. FIG. 11 illustrates the electrical contacts 314 on side 305 of the plug interface 310. Optionally, the electrical contacts 312 and 314 can each be provided on any one of the top 301, the bottom 303, the side 305, or the side 307. A plug latch 316 is configured to mate with a corresponding latch on the plug to secure the plug within the plug interface 310. The plug latch 316 is positioned along the top 301 of the plug interface 310. Optionally, the plug latch 316 may be provided on any one of the top 301, the bottom 303, the side 305, or the side 307.

A cap 320 is joined to the mating end 308 of the connector body 304. The cap 320 includes a top 321, a bottom 323, and a pair of sides 325. A front face 324 extends at least partially between the top 321, the bottom 323, and the pair of sides 325. The front face 324 has a surface 326 that corresponds to the surface 57 of the front face 56 of the panel 52. The front face 324 includes an opening 328 extending therethrough. The top 321, the bottom 323, and the sides 325 of the cap 320 engage the mating end 308 of connector body 304 so that the plug interface 310 is accessible through the opening 328 of the cap 320.

The electrical connector 300 is configured to be rear mounted to the panel 52 so that the surface 326 of the front face 324 of the cap 320 is positioned flush with the front face 56 of the panel 52. The surface 326 of the cap 320 may be planar to correspond to a planar surface 57 of the panel 52. Alternatively, the surface 326 may be non-planar and configured to correspond to a non-planar surface 57 so that a transition between the surface 57 and the surface 326 is limited. The electrical connector 300 is mounted to the panel 52 so that a step is not formed between the surface 57 and the surface 326. The cap 320 may be fabricated with a color that corresponds to a color of the panel 52.

The connector housing 302 includes a retaining surface 330 that extends around the plug interface 310. The retaining surface 330 includes a top 332, a bottom 334, and a pair of sides 346. The top 321 of the cap 320 is configured to be joined to the top 332 of the connector housing 302. The bottom 323 of the cap 320 is configured to be joined to the bottom 334 of the connector housing 302. The sides 325 of the cap 320 are configured to be joined to the sides 346 of the connector housing 302. The sides 321, 323, and 325 of the cap 320 correspond to the sides 332, 334, and 336 of the connector housing 302 so that the cap 320 positions flush on the connector housing 302.

The top 332 of the connector housing 302 includes a tab 350 that is configured to engage the top 321 of the cap 320 when the cap 320 is positioned on the connector housing 302. A notch 354 is formed in each side 336 of the connector housing 302 proximate to the top 332 of the connector housing 302. A notch 356 is also formed in each side 336 of the connector housing 302 proximate to the bottom 334 of the connector housing 302. Each side 336 of the connector housing 302 includes a tab 358 extending therefrom. The tab 358 is positioned between the notch 354 and the notch 356. A pair of tabs (not shown) may also be formed on the bottom 334 of the connector housing 302 to engage the bottom 323 of the cap 320.

Figure 12:
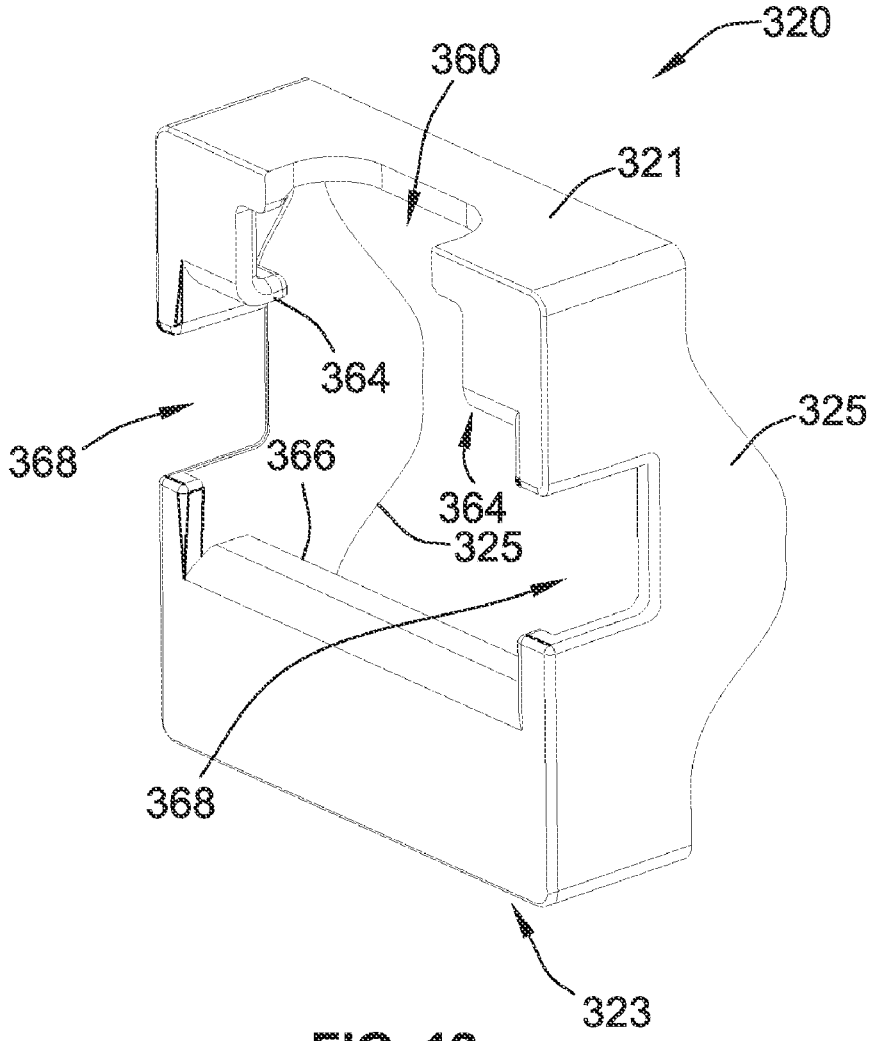
FIG. 12 is a front perspective view of the cap, shown in FIG. 11.

FIG. 12 is a front perspective view of the cap 320. The top 321 of the cap 320 includes a recess 360 formed therein. Flanges 364 extend proximate to the top 321 of the cap 80. A flange 366 also extends proximate to the bottom 323 of the cap 320. The sides 325 each include a recess 368 formed therein. The recess 368 is positioned between the flanges 364 and the flange 366. The bottom 323 of the cap 320 may also include tabs (not shown) provided along the bottom 323 of the cap 320.

When the cap 320 is joined to the connector housing 302, the flange 366 rests within the notches 356 and the flanges 364 rest within the notches 354 to align the cap 320 with respect to the connector housing 302. The cap 320 is aligned so that the plug interface 310 is accessible through the opening 328 of the cap 320. The tabs 358 are received in the recesses 368 and the tab 350 is received within the recess 360 to secure the cap 320 to the connector housing 302.

Figure 13:
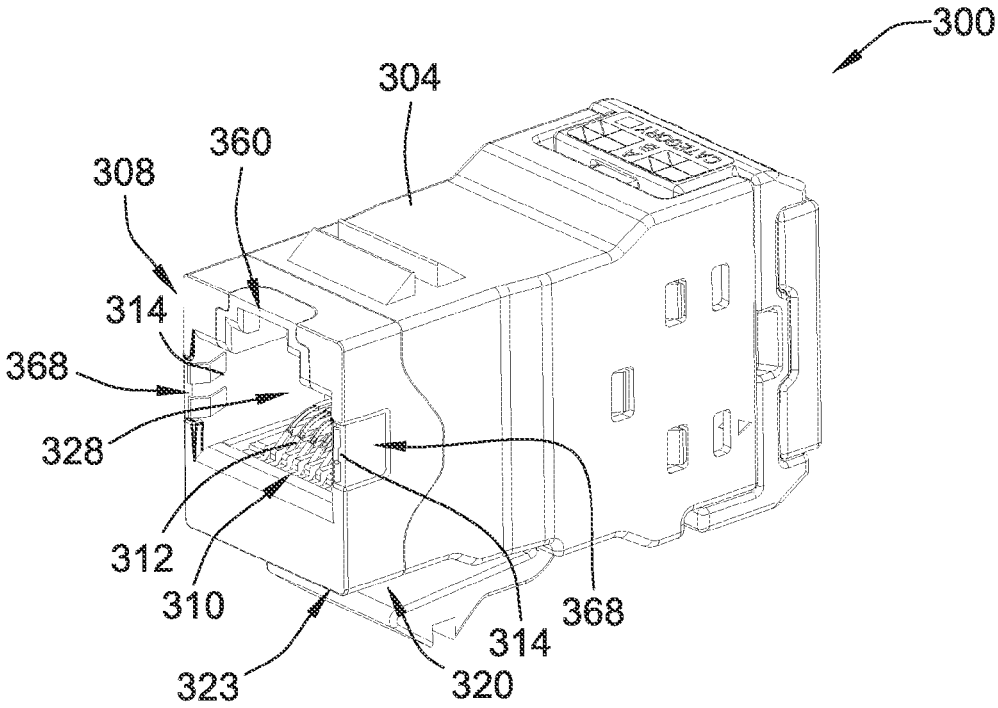
FIG. 13 is a front perspective view of the electrical connector, shown in FIG. 11.

FIG. 13 is a front perspective view of the electrical connector 300. The cap 320 is positioned on the mating end 308 of the connector body 304 so that the plug interface 310 is accessible through the opening 328 of the cap 320. The electrical contacts 312 and 314 of the plug interface 310 are accessible through the opening 328. The electrical contacts 312 are accessible proximate to the bottom 323 of the cap 320. The electrical contacts 314 are accessible through a recesses 368 formed in the sides 325 of the cap 320. The plug latch 316 is also accessible through the opening 328. The plug latch 316 is accessible through the recess 360 formed in the top 321 of the cap.

Figure 14:
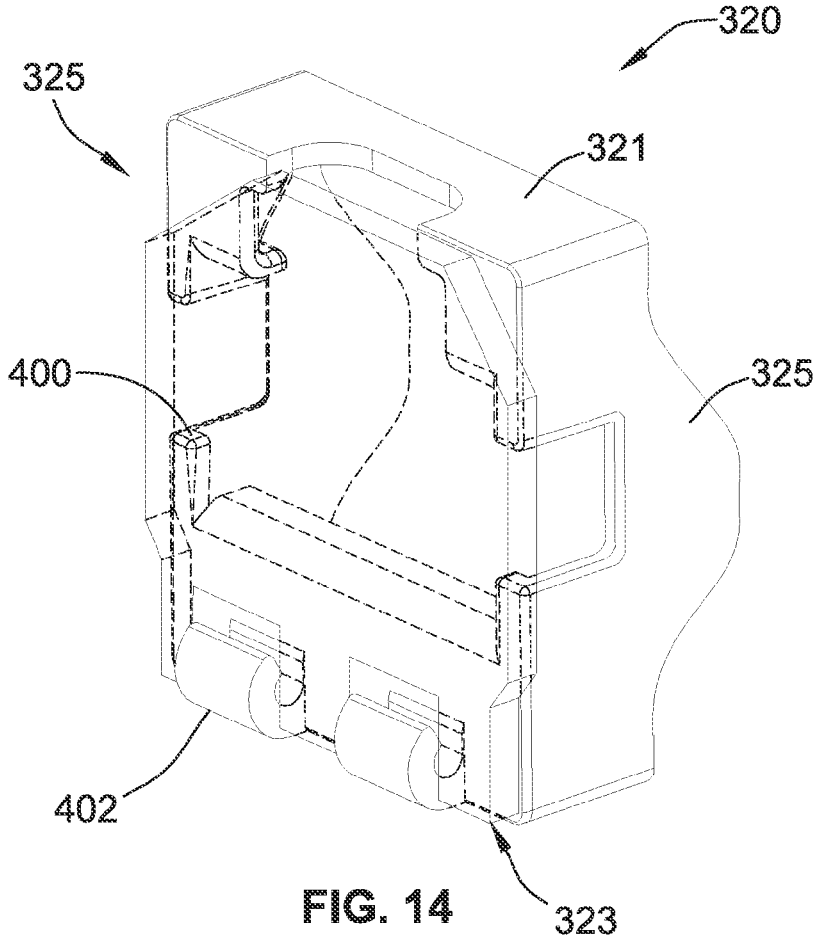
FIG. 14 is a front perspective view of the cap, shown in FIG. 12, having a dust cover.

FIG. 14 illustrates the cap 320 having a dust cover 400. Hooks 402 extend from the bottom 323 of the cap 320. The hooks 402 are configured to retain the dust cover 400. In a closed position, the dust cover 400 covers the opening 328 of the cap 320 to prevent access to the plug interface 310. The dust cover 400 limits an amount of dust and debris that enters the plug interface 310. The dust cover 400 rotates about the hooks 402 into an open position, wherein the plug interface 310 is uncovered and accessible. In an alternative embodiment, the hooks 402 may be positioned on the top 321 or on one of the sides 325 of the cap 320.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a housing having a body with a cable end and a mating end, the mating end comprising a plug interface configured to receive a plug, the mating end having a retaining surface defined around the plug interface, the retaining surface having a contour, at least one retention feature provided on the retaining surface; and a cap defined by a plurality of sides, a contour of the plurality of sides of the cap corresponding to the contour of the retaining surface, a front face extending at least partially between the plurality of sides, an opening extending through the front face, the cap mounted to the mating end of the housing so that at least one of the plurality of sides of the cap engages the at least one retention feature to secure the cap to the housing, the plug interface of the housing accessible through the opening in the cap, the housing configured to be rear mounted to a panel so that the plug interface is accessible through an opening in the panel and the front face of the cap enables the connector to be positioned flush with a front face of the panel.

2. The electrical connector of claim 1, wherein the retention feature includes a notch formed in the retaining surface, at least one of the plurality of sides of the cap including a tab configured to be received within the notch.

3. The electrical connector of claim 1, wherein the retention feature includes a tab formed on the retaining surface, at least one of the plurality of sides of the cap including a notch configured to receive the tab.

4. The electrical connector of claim 1, wherein the cap includes a top side, a bottom side, and a pair of opposed sides, a recess provided in each of the opposed sides and configured to engage a retention feature of the housing.

5. The electrical connector of claim 1, wherein the cap includes a top side, a bottom side, and a pair of opposed sides, a recess provided in the top side and configured to engage a retention feature of the housing.

6. The electrical connector of claim 1, wherein the cap includes a top side, a bottom side, and a pair of opposed sides, a tab provided on the bottom side and configured to engage a retention feature of the housing.

7. The electrical connector of claim 1, wherein the retaining surface includes a notch and the front face of the cap includes a flange extending therefrom, the flange received within the notch to retain the cap on the housing.

8. The electrical connector of claim 1, wherein the plug interface includes an electrical contact to shield the plug received within the plug interface, the electrical contact accessible through the opening in the cap.

9. The electrical connector of claim 1, wherein the housing body has an outer surface, a surface of each of the plurality of sides of the cap configured to position flush with the outer surface of the housing when the cap is mounted to the housing.

10. The electrical connector of claim 1, wherein the housing includes a top, a bottom, and a pair of opposed sides, the retaining surface extending along each of the top, the bottom, and the pair of opposed sides.

11. The electrical connector of claim 1 further comprising a dust cover joined to the front face of the cap, the duct cover configured to cover the opening extending through the front face of the cap.

12. An electrical assembly comprising:

an electrical connector including a housing having a body with a cable end and a mating end, the mating end comprising a plug interface configured to receive a plug, the mating end having a retaining surface defined around the plug interface, at least one retention feature provided on the retaining surface, the housing body having an outer surface; and a cap defined by a plurality of sides, a front face extending at least partially between the plurality of sides, an opening extending through the front face, the cap mounted to the mating end of the electrical connector so that at least one of the plurality of sides of the cap engages the at least one retention feature to secure the cap to the electrical connector, a surface of each of the plurality of sides of the cap configured to position flush with the outer surface of the housing body when the cap is mounted to the housing, the plug interface of the electrical connector accessible through the opening in the cap, the cap configured to install onto the electrical connector without increasing an overall size of the electrical connector so that the electrical connector is mountable in an existing panel, the electrical connector rear mounted to the existing panel so that the plug interface is accessible through an opening in the existing panel.

13. The electrical assembly of claim 12, wherein the retention feature includes a notch formed in the retaining surface, at least one of the plurality of sides of the cap including a tab configured to be received within the notch.

14. The electrical assembly of claim 12, wherein the retention feature includes a tab formed on the retaining surface, at least one of the plurality of sides of the cap including a notch configured to receive the tab.

15. The electrical assembly of claim 12, wherein the retaining surface of the housing includes a notch and the front face of the cap includes a flange extending therefrom, the flange received within the notch to retain the cap on the housing.

16. The electrical assembly of claim 12, wherein the plug interface includes an electrical contact to shield the plug received within the plug interface, the electrical contact accessible through the opening in the cap.

17. The electrical assembly of claim 12, wherein the housing includes a top, a bottom, and a pair of opposed sides, the retaining surface extending along each of the top, the bottom, and the pair of opposed sides.

18. The electrical assembly of claim 12 further comprising a dust cover joined to the front face of the cap, the duct cover configured to cover the opening extending through the front face of the cap.

19. An electrical connector comprising:

a housing having a body with a cable end and a mating end, the mating end comprising a plug interface configured to receive a plug, the mating end having a notch formed in each side of the housing proximate to the bottom of the housing, the notches extending from the plug interface; and a cap defined by a plurality of sides, a front face extending at least partially between the plurality of sides, an opening extending through the front face, the cap having a flange positioned proximate to the bottom of the cap, the flange being positioned in the notches when the cap is attached to the housing, the plug interface of the housing accessible through the opening in the cap, the housing configured to be rear mounted to a panel so that the plug interface is accessible through an opening in the panel and the front face of the cap enables the connector to be positioned flush with a front face of the panel.

20. The electrical connector of claim 19, wherein the flange extends along a bottom of the opening of the front face, the flange positioned in the plug interface when the cap is joined to the housing.

* * * * *